United States Patent [19]

Rohrbach, deceased

[11] 3,991,943

[45] Nov. 16, 1976

[54] PROCESS AND EQUIPMENT FOR THE PRODUCTION OF ULTRAFINE POWDERS PARTICULARLY OF COAL POWDERS WITH THE HELP OF A CONTINUOUS COLD WARM INFLUENCE ON THE GROUND MATERIAL

[75] Inventor: Hans Rohrbach, deceased, late of Bergen, Germany, by Herta Rohrbach, administratrix

[73] Assignee: Ilok Powder Company, Inc., Washington, D.C.

[22] Filed: Mar. 20, 1975

[21] Appl. No.: 560,400

[30] Foreign Application Priority Data

Mar. 21, 1974 Germany ..... 2413595

[52] U.S. Cl. ..... 241/1; 241/23

[51] Int. Cl.[2] ..... B02C 23/00

[58] Field of Search ..... 241/1, 23

[56] References Cited

UNITED STATES PATENTS

| | | | |
|---|---|---|---|
| 1,311,645 | 7/1919 | Foss | 241/23 |
| 1,679,857 | 8/1928 | France | 241/1 |
| 3,797,757 | 3/1974 | Marshall | 241/1 |

*Primary Examiner*—Granville Y. Custer, Jr.
*Attorney, Agent, or Firm*—Laurence R. Brown

[57] ABSTRACT

A process is disclosed for conversion of coal powder of 4 micron size into a finer powder of the order of 1/400 micron by passing through a vertical tube of sufficient length at a temperature of −77° C and thereafter passing through a second chamber by force of gravity where a counter stream of heated nitrogen at 780° C causes the powder to break up into the smaller size particles.

9 Claims, 3 Drawing Figures

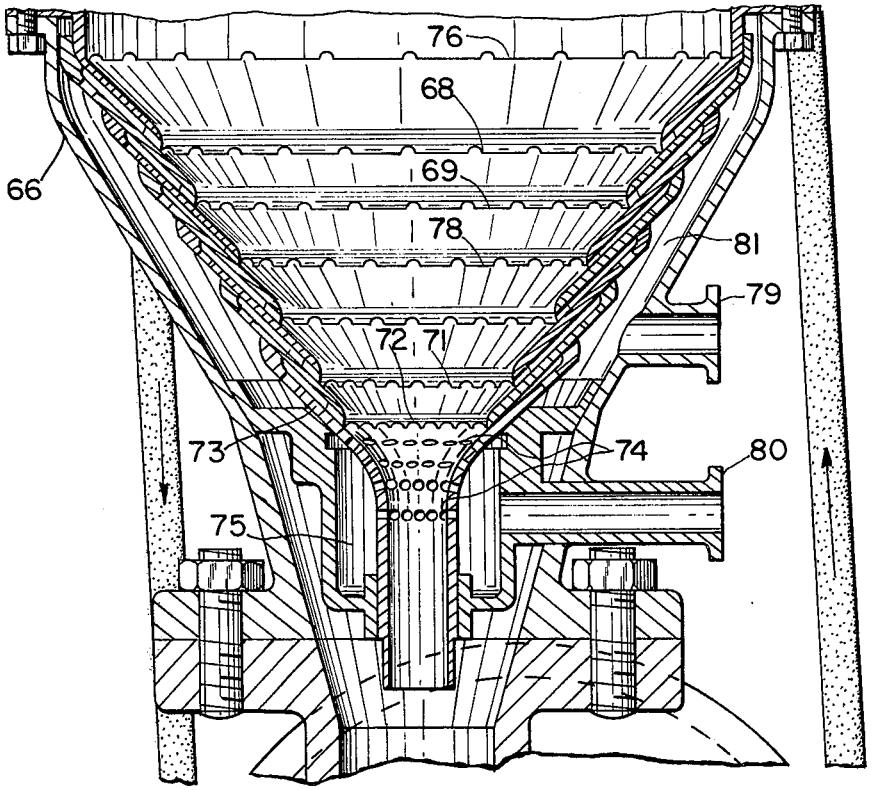
FIG. 2
FIG. 3
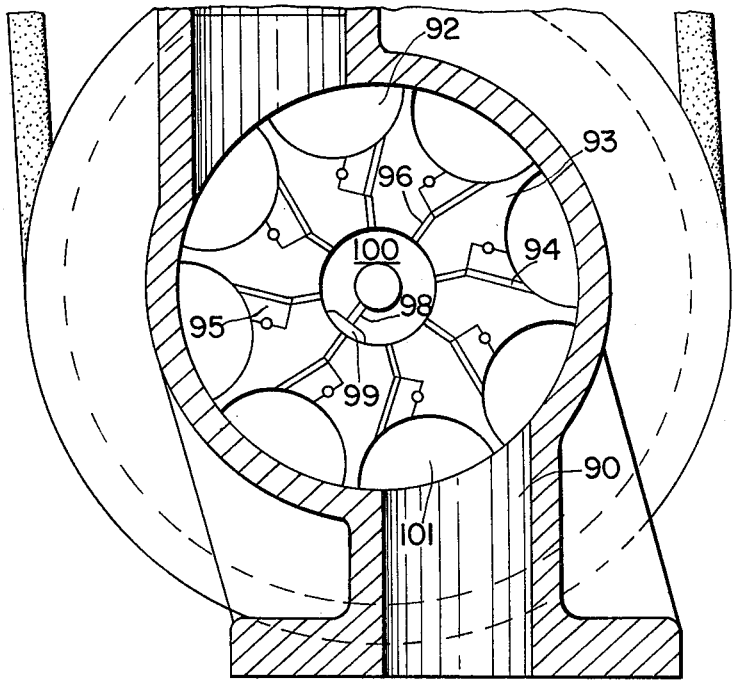

PROCESS AND EQUIPMENT FOR THE PRODUCTION OF ULTRAFINE POWDERS PARTICULARLY OF COAL POWDERS WITH THE HELP OF A CONTINUOUS COLD WARM INFLUENCE ON THE GROUND MATERIAL

BACKGROUND OF THE INVENTION

This invention relates to improvement of fuels and more specifically provides that a supply of energy fuels such as coal may be refined so that combustion with oxygen in air can be accomplished more rapidly than heretofore.

Until recently the smallest coal particles produced by reduction in mechanical mills were usually in the order of 75 microns. By using electro-filters for example particles of 35 microns size have been reached. Although laboratory amounts may be known, commercially usable quantities with a fineness of 5 microns as required by industry have not been universally available.

According to recent developments hereinafter set forth, a fineness of 4 microns can nevertheless be obtained in large amounts commercially, and in accordance with the process of this invention uses such as feed material which is then additionally refined up to 1/300 micron through a purely thermal treatment. The 4 micron size is achieved through a mechanical grinding process, which is described in the transcript of Hearings on S 2806 before the Ninety-Third Congress on Jan. 28, 1974, pages 1632 and 1633 and which are disclosed as known art in German patent 690653, May 3, 1940. This art complements and comprises part of this particular application, and explains how the new 4 micron powders are mechanically produced.

This invention, however, deals with the production of the "ultrafine powder" in the size of 1/300 micron for which the powder of 4 micron size is the feed material. The 4 micron powder that leaves the mechanical reductor mill then falls from above by gravity into an apportioning-chamber-wheel, where it is quantitatively measured and then empties below. By this process the exiting powder is controlled with the help of a revolving gate in such a manner that the 4 micron powder may be withdrawn or it falls vertically from the chamber-wheel into a vertical discharge line below for an additional thermal treatment. This discharge line on its upper end is provided with blow-off holes, through which nitrogen is fed under a small pressure so that the falling 4 micron powder cannot settle on curvatures of the pipe conduit and therefore continues falling.

The vertical discharge line is surrounded with a concentric cylinder housing, in which a helix type passageway is placed adjacent to the discharge line. Through this helix liquid ammonia at minus 77° C is fed upwardly from below. To avoid heating of the ammonia-helix from the outside, the cylinder housing is provided with a jacket, with hollow spaces between the inner and outer cylinder housing tightly filled with glass wool or asbestos so that the outer space heat cannot have any effect on the ammonia cooling. At the top of the housing the ammonia is led out through a separate pipe line and returns to a container.

The falling 4 micron powder is now cooled to minus 77° C. on the bottom part of the discharge line to fall into a second apportioning-chamber-wheel. The space above and below the apportioning-chamber-wheel is sealed so that it is never possible for the powder in the pipe conduits and in the chambers to move backwards nor for the air from the outside to penetrate inside. Thus, the upper 180° circumference of the second apportioning-chamber-wheel is cooled to the temperature of minus 77° C.

The very cold powder, apportioned in the second chamber falls now through a short connecting pipe into a larger thermal chamber, fitted below. The larger chamber has the form of a cylinder, and similarly to the preceding cold chamber, it is also surrounded with an insulation housing. This insulation housing is also filled with glass wool, asbestos or also through a vacuum in the double housing suitable for not allowing the prevailing very high temperature of plus 780° C within the inner cylinder space to flow to the outside.

On the upper end of the thermal cylinder is located an annular space around the outer insulation housing. This annular space is connected with the inner space of the hollow thermal cylinder through multiple small connecting pipes, which are radially arranged, and extend through the insulation housing. Hot nitrogen gas is fed into the hollow thermal cylinder at a temperature of plus 780° C through a sideway-flanged transverse pipe, located at half height. This feeder transverse pipe is bent upwards at 90° in the vicinity of the axis of the hollow cylinder so that its exit is exactly concentric with the feeder pipe for the cold 4 micron powder.

It is important that the feeder pipe for the 4 micron powder is 1.5 times larger in diameter than the feeder pipe for the heated nitrogen, which flows in opposite direction. The distance between the concentrically arranged ends of the two opposing pipes is twice that of the diameter of the feeder pipe for the 4 micron powder. The previously indicated annular space, with the help of the small radially arranged transverse pipes, serves for the collection of the hot nitrogen gas and for the removal of this gas back to a central container. Directly below the gas collection outlets for these radial small pipes are placed two transverse foils, that are provided with very fine ½ m/m borings. Between the two foils is a tightly pressed filling of glass-wool arranged in such a manner to serve as a filter for the ultrafinest powder that is being produced by operating gas flowing up from the lower part of the hollow thermal cylinder to the upper annular space.

Two streams meet in the large cylinder space directly and concentrically upon each other:

a. the minus 77° C cold 4 micron powder, and b. the plus 780° C hot nitrogen, whereby the fine powder, which comes from above into the gas stream coming from below, is driven towards the wall of the cylinder and at the touch of the minus 77° C cold coal powders with the 780° C hot gas-mass, due to the existence of gas-filled macro-pores in the 4 micron coal, these particles explode, whereby they are torn apart into the "ultrafinest coal" of the size 1/300 micron. According to experience and many tests, at the conclusion of this process 97.3% of the feed material from the mechanical reductor mill is converted to the ultrafinest coal of 1/300 micron.

At the bottom of the large thermal cylinder is a compactor, whose function is to pack the very fine powder from the large cross section of the thermal container to a sufficiently small stream so that it can be fed to storage.

The compactor consists basically of a funnel like housing, which is attached to the thermal cylinder with a screw flange. On the outside of this funnel in the transverse direction to the main axis of the device are two transverse tubes placed one above the other for the bringing in of nitrogen, which serves as a blow and conveyor means for the very fine powder.

The funnel like housing is assembled from various conical rings with the smallest ring fastened near the bottom of the conical cast funnel housing with a solid socket. A series of progressively larger rings, one following the preceding one, and steadily growing in size, and concentrically arranged so that the uppermost and largest ring has an inner diameter extending to the wall of the large thermal cylinder. The various conical inset-rings in the conical funnel housing are firmly attached to insure against their dislocation. All the conical inset-rings have milled grooves on the outside gas passage holes at the smallest diameter (lower) end allowing gas flow upwardly from smaller to larger rings. Also in the vicinity of its upper and largest diameter each ring has, over its entire circumference, a quantity of small equally spaced borings through which likewise nitrogen under small pressure passes between two rings. The nitrogen is blow inside into the funnel space so that the powder cannot settle on the inner conical spaces of the rings, and so that the falling powder is blow into the funnel toward the smallest conical ring. There in the narrowest part of the last conical ring, through a great number of the smallest borings, a real sieve has been produced through which nitrogen streaming in from the outside is continually blown so that no powder can settle down in the throat of the cone but is always blown out downwardly.

Below the compactor is built, in a separate housing, an apportioning wheel, respectively the third such wheel in such a way that the ultrafine powder is now seized from this wheel and is led to the eventual storage place. The third apportioning wheel conducts the falling powder from the compactor into the outlet tube below the apportioning wheel, from where, by means of nitrogen, it can be transported at will to any distance.

In the third apportioning wheel, through corresponding borings and slits, the powder that falls in from the apportioning chambers can be blown out so that each chamber can be flushed out. It must still be pointed out that all the three apportioning wheels have the same diameter in size, same sized powder chambers and same number of revolutions. To achieve this goal all three chamber-wheels are driven with the same V-belt. It should additionally be pointed out that each apportioning conveyor wheel both in the inflow and outflow direction against the nearest machined parts is completely gas sealed so that the various adjacent spaces and ducts are completely sealed regarding pressures and quantities.

When on the upper end of the entire device the before mentioned reducing mill is mounted, raw coal in the size of 25 m/m (nutcoal IV) is reduced to 4 micron size, the coal that has to be processed can be comminuted up to the size of 1/300 micron in one single throughput so that the entire process will be extraordinarily economical.

THE DRAWING

In the hereinafter following description of the accompanying drawing all construction parts will be more closely identified.

FIG. 1 is an elevation view, partly in section, FIG. 2 is an enlarged detail section of a conical compactor, and FIG. 3 is an enlarged detail section of a fine powder processing apportioning conveyor wheel.

DETAILED DESCRIPTION

Figure 1:
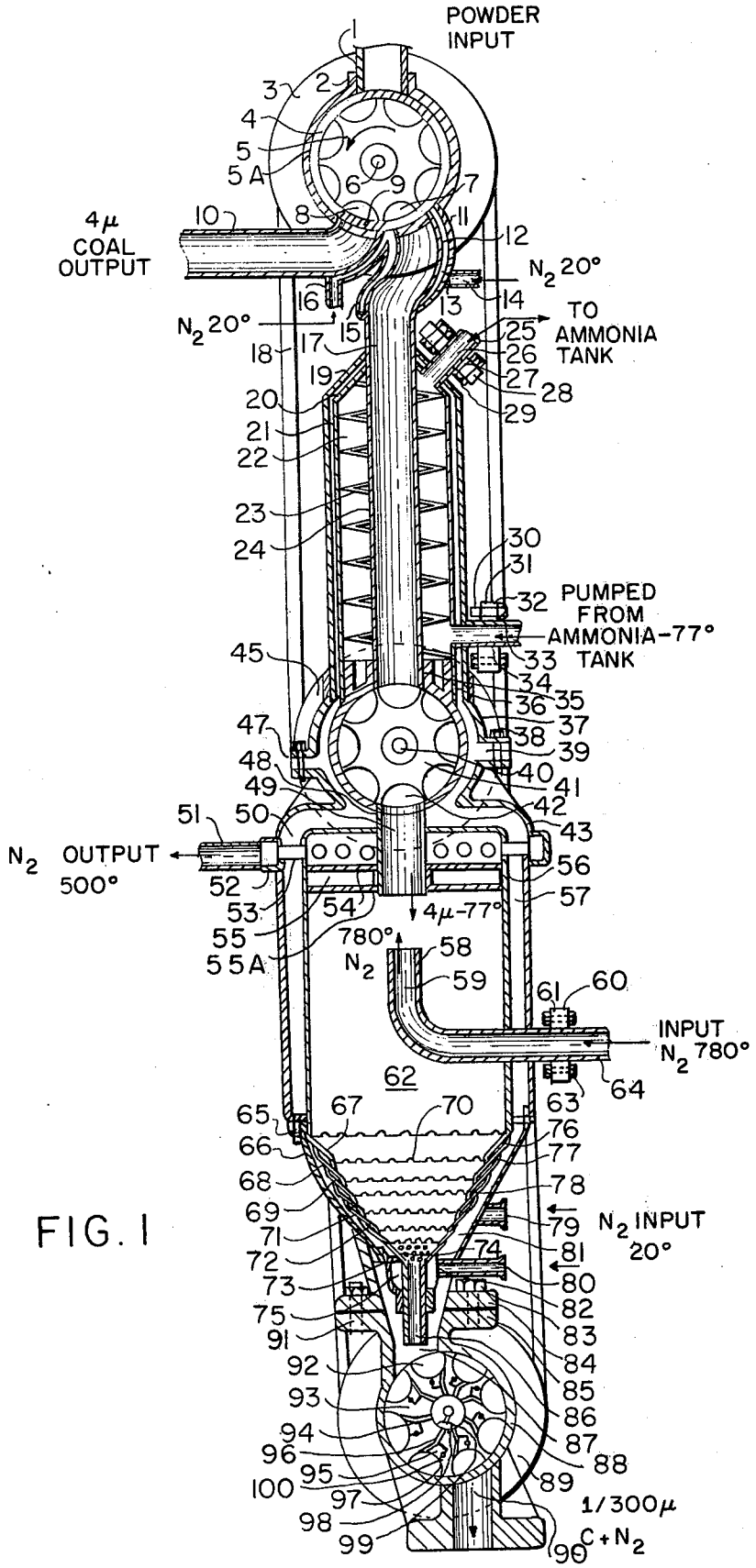

In the drawing at the top 1 the fine powder, reduced to a 4 micron size, enters the conversion device. This powder arrives into the first apportioning wheel 5, having the apportioning chambers 7 and 8. The apportioning wheel is in a housing 2 having therein a revolving gate 4. The apportioning shaft 6 is propelled by the pulley 3 and V-belt 18. The direction of revolution is counter clockwise. By the turning of the apportionment conveyor wheel the fine powder of 4 micron size empties from the chamber 8 into the discharge tube 10 through which only the 4 micron powder can be led off. When, however, the revolving gate 4 is in such a position that the exit 9 is closed, then the 4 micron powder will get from the chamber 7 over the open pipe 11 into the inlet-tube for the powder, which shall be additionally refined to the size of 1/300 micron, i.e. into the discharge tube 24.

The pipe curvatures of 10 and 11 in their upper part are provided with many small borings at position 12 (not shown) through which by pipes 14, 15 and 16 nitrogen is blown in the space 13, to prevent the accumulation of the 4 micron powder on the curvatures. Through such blowing in from the outside any settling or conglomerating of the fine powder is prevented. The powder must be led off therefore through either through the tube 10 or the tube 17.

As the powder of the 4 micron size must be further cooled to minus 77° C, the vertical tube 24 is surrounded with a housing 21 within which in space 22 is built in a helix 23. To prevent the housing from absorbing any heat from the outside, an additional protective tube 19 covers the housing concentrically. The interspace between 19 and 21 is filled with good insulation means, in this case with glass wool or asbestos 20. Down below, on the housing 21, transversely and directed toward the concentric axis of the pipes, is a connecting pipe 33, mounted with the flange parts 31 and 32 and with the screws 30. By a pump which is not shown, liquid ammonia is fed into pipe 33 to flow upwardly over the entire height of the helix while cooling the tube 24 to nearly minus 77° C. At pipe 25 the ammonia leaves the device and streams off to an intermediate tank, which is not shown. The exit pipe 25 is mounted with the help of flanges 27 and 28 and with screwed joints 29, and is welded to the housing pipe 21.

Below the discharge tube 24 is the second conveyor and apportioning wheel 41. This conveyor wheel by V-belt drive 18 and the pulley 45 is connected with upper conveyor wheel 5, and runs synchronously with the same number of revolutions counter clockwise. The wheel 41 runs in housing 35, which closes off the lower end of space 22. The housing 35 is surrounded by the housing 39 and is located in the lower end of the pipe 36. The bottom flange to the screwed joint of the conveyor wheel 41 is formed from the head-part of the housing 43 that lies further below. Both halves of the housing, respectively the bearing halves of the apportioning wheel 41 are drawn together with the help of screws 38 so that insulation 50 — again glass wool or asbestos — reaches up between the flanges 37 and 43. The cavities 42 are the conveyor chambers of the conveyor wheel 41.

The 4 micron powder now cooled to minus 77° C falls into the discharge tube opening 48 and from there downwardly into tube 49. This tube 49 empties from above into the space 62, which is formed by the pipe 56. This space 62 is likewise formed from a double-walled tube 56 and 43, whose intermediate space is fitted out with an insulation material — glass wool or asbestos — but which space can also be insulated through a vacuum. The pipe 49, at its lower end, is surrounded by a pair of panels 54 and 55*a*, between which glass wool is inserted. The metal sheet panels 54 and 55*a* are provided with many small holes so that together, with the inserted glass wool 55 it forms an excellent filter. Above this filter, around the entire circumference of the pipes 56 and 43 and radially directed towards the axis, small transverse tubes 53 are welded so that warm nitrogen heating gas, which at plus 780° C has been fed into the chamber 62 can be drawn off through the filter without, however, being able to carry with it the produced ultrafinest powder of 1/300 microns, because this powder will be held back on the filter 55 and will return into the large thermal chamber 62.

The heating gas 59, which was led in through the tube 58, counter the stream of coal at 49, passes the filter 55 through the small tubes 53 into the annular space 52 and from there through the exit pipe 51, where it empties into a gas tank not shown.

The ultrafinest powder of 1/300 micron falls from the thermal container 62 into a conical compactor 66 to 84 placed underneath. The conical compactor consists firstly of a conical outer cast-housing 66 on which at the bottom is the flange 84 for the screwed joint with the housing 85. On the cast-housing 66 are found both the pipe shoulders 79 and 80 through which the nitrogen can be continuously fed in — under a small pressure — to reach spaces 75 and 81.

As may be seen from the enlarged FIG. 2 structure, the flow path for $N_2$ from pipe 79 can be traced within the housing 66 through the various cone sections 68, 69, 78, etc.

In the conical housing 66 at the bottom, is inserted the control piece 73, which is conically sealed. Into this control piece 73 is inserted the smallest conical ring 72, which at its bottom end holds a perfect sieve made of a series of holes 74. This sieve insert, in the vicinity of its largest diameters, contains also additionally a great number of small borings through which the gas under pressure can pass inside from the space 81. Thus follow always larger conical insert-rings 71, 78, 76, 69 and 68. All these rings are provided at their largest diameter with such small holes, and at their smallest diameter, outside, with milled cuts in the form of canals, so that the gas under pressure, can always pass through the holes into the milled cuts of the following (succeeding) ring and thus it blows off completely the finest powder that was about to settle down from the nearest lower ring. The powder reaches in this manner, step by step, the bottom and finally it falls into the tube 86, and thereafter into the transmission tube 87 to get finally into the third conveyor-and-chamber wheel 93. The connection 88 with the housing 85 is carried out through the screwed joints 83 and 91. The chamber wheel 93 is shown in a section so that the insert parts, with the help of wedge shaped pieces 95 form the canals 94 and 96, can be well recognized.

The canals 94 are connected with the radial borings 96. When the chamber wheel rotates these canals are continuously overrun in their hollow space 99, which on its side is connected with a boring 98 coming out from the shaft boring 100. After the passing of this apportioning wheel, the ultrafinest powder falls now finally to the bottom through the pipe 90 and it can be fed out for any use. The conveyor wheel 93 — like the other two conveyor wheels — is connected directly with both the other two conveyor wheels through the V-belt traction by means of pulley 89 and thus the conveyor wheel 93 shares with the other two conveyor wheels the same number of revolutions and the same direction of rotation.

As described in the doctoral thesis of Dr. Ing. Hans Rohrbach published in October, 1971 in Mtz Motortechnische Zeitschrift, and as shown in FIG. 8 of the Technical Feasibility Report of Dr. V. Stephen Krajcovic-Ilok of July 5, 1972, the function of wheel 93 as better seen from the enlarged view of FIG. 3 is as follows. Wheel 93 turns counterclockwise and carries powder and nitrogen gas downwardly in the separate apportioning chambers 92, etc. around to the outlet pipe 90. The canals 94 provide rinsing air fed into the wheel shaft when connected with boring 98 and hollow space 99 to cause the apportioning chamber 101 to be washed out as it enters contact with pipe 90.

I claim:

1. The process for conversion of fine powder, preferably coal powder, of the order of 4 micron size into finer powder in the order of 1/300 to 1/500 micron size, comprising in combination the steps of:

letting the fine powder fall through a vertical tube by force of gravity, cooling the tube to a temperature in the order of minus 77° C to chill the fine powder, letting the chilled fine powder fall vertically by force of gravity through an insulated thermal chamber, and passing a stream of heated inert gas in the order of 780° C upwardly through the powder in a direction counter to the fall of said chilled powder thereby to tear apart the fine powder to finer powder of the sizes aforesaid.

2. The process defined in claim 1 including the steps of feeding the fine powder into the vertical tube and the thermal chamber each by respective similar apportioning wheels assemblies rotating at the same speed.

3. The process defined in claim 2 including the steps of compacting said finer powder as it passes downwardly in said thermal chamber, and feeding the compacted powder to an external feed tube by a third apportioning wheel assembly rotating at the same speed as the first two said wheels.

4. The process defined in claim 3 comprising the step of sealing off in a gas tight manner three adjacent vertically positioned compartments comprising said vertical tube, said thermal chamber and said external feed tube by means of said apportioning wheel assemblies.

5. The process defined in claim 4 where each conveyor wheel has a series of circumferentially located compartments all of the same size, and including the step of synchronizing rotation of the wheels to alternate the compartments in sequence respectively with the powder inlets and outlets thereto.

6. The process defined in claim 1 including the step of removing said heated gas through a filter preventing passage of said powder.

7. The process defined in claim 1 wherein the finer powder is compacted after falling through said thermal chamber by means of a series of adjacent conical rings of decreasing size arranged to pass a stream of inert gas therethrough to the interior thereby to cause a stream of said finer powder to pass through the smallest conical ring.

8. The process defined in claim 1 wherein the chilled powder is passed through an inlet tube of given diameter into said thermal chamber and said stream of gas is introduced by a pipe along the axis of said tube at a distance approximately twice the diameter of said inlet tube.

9. The process defined in claim 1 including the step of withdrawing the heated gas from a space about said inlet pipe thereby to cause dispersal of said falling powder in a direction substantially perpendicular to the axis of said inlet tube.

* * * * *